US010767959B2

(12) United States Patent
Ji et al.

(10) Patent No.: US 10,767,959 B2
(45) Date of Patent: Sep. 8, 2020

(54) DEVICE AND METHOD OF RECOIL REDUCTION FOR AIR GUNS

(71) Applicant: XISICO USA, INC., Houston, TX (US)

(72) Inventors: Xiaoping Ji, Zhejiang (CN); Yecheng Wu, Zhejiang (CN); Xiaoqiang Sheng, Zhejiang (CN); Shengping Zeng, Zhejiang (CN); Fuying Ji, Zhejiang (CN); Ye Sun, Zhejiang (CN); Chengxin Du, Zhejiang (CN)

(73) Assignee: XISICO USA, INC, Houston, TX (US)

( * ) Notice: Subject to any disclaimer, the term of this patent is extended or adjusted under 35 U.S.C. 154(b) by 0 days.

(21) Appl. No.: 14/983,409

(22) Filed: Dec. 29, 2015

(65) Prior Publication Data

US 2017/0184372 A1 Jun. 29, 2017

(51) Int. Cl.
*F41B 11/644* (2013.01)
*F41B 11/643* (2013.01)

(52) U.S. Cl.
CPC ..... *F41B 11/644* (2013.01); *F41B 11/643* (2013.01)

(58) Field of Classification Search
CPC ..... F41B 11/643; F41B 11/644; F41B 11/645
USPC ..... 124/76
See application file for complete search history.

(56) References Cited

U.S. PATENT DOCUMENTS

| | | | | | |
|---|---|---|---|---|---|
| 3,233,602 | A * | 2/1966 | Partanen | F41B 11/644 | 124/37 |
| 4,870,945 | A * | 10/1989 | Hutchison | F41B 11/645 | 124/64 |
| 5,133,331 | A * | 7/1992 | Hutchinson | F41B 11/644 | 124/66 |
| 8,056,276 | B2 * | 11/2011 | Hu | F41A 33/06 | 124/65 |
| 8,074,392 | B2 * | 12/2011 | Hu | F41B 11/644 | 124/65 |
| 8,449,346 | B2 * | 5/2013 | Lee | F41B 11/644 | 124/1 |
| 2008/0155875 | A1 * | 7/2008 | Iwasawa | F41B 11/89 | 42/54 |
| 2009/0101130 | A1 * | 4/2009 | Hu | F41A 33/06 | 124/80 |
| 2009/0127758 | A1 * | 5/2009 | Hu | F41B 11/644 | 267/167 |
| 2012/0138038 | A1 * | 6/2012 | Lee | F41B 11/644 | 124/80 |

FOREIGN PATENT DOCUMENTS

| | | | |
|---|---|---|---|
| EP | 2631588 | * | 2/2013 |
| EP | 2899490 | * | 5/2014 |
| WO | WO2008099514 | * | 8/2007 |

* cited by examiner

*Primary Examiner* — Joshua E Freeman
(74) *Attorney, Agent, or Firm* — Lai, Corsini & Lapus, LLC; Theodore Lapus

(57) ABSTRACT

The present invention relates to a recoil reduction air gun and a method of reducing recoil of air guns when discharging. Said recoil reduction air gun comprises a cylinder that is slidably mounted to a main body of said air gun, and a recoil reduction device that is provided between the cylinder and a stock. Said recoil reduction device further comprises a recoil reduction spring seat, a first and a second springs, and a recoil rod.

9 Claims, 5 Drawing Sheets

DEVICE AND METHOD OF RECOIL REDUCTION FOR AIR GUNS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND

Field of the Invention

This invention relates to a recoil reduction air gun and more particularly, to a device and a method of a recoil reduction for the air gun. Even more particularly, to the device and the method of the recoil reduction for a spring-piston air gun.

Background of the Invention

Air guns discharge pellets by compressed air. A spring-piston air gun compresses air by compressing a spring together with a piston in a cylinder or a gas chamber towards a trigger. When discharging, the spring is released which allows the piston to travel along the cylinder towards a muzzle of the air gun, by which the air in the cylinder is compressed and the pellet is expelled.

Releasing the spring causes vibrations including a recoil. The recoil leads the air gun moving backwards and to a shooter, and is substantially transmitted to and absorbed by the shooter's shoulder. As a muzzle speed of the pellets increases, said recoil increases accordingly, so does a impact caused by the recoil and to the shooter.

The vibrations also transmits along other directions. The more substantial the vibrations are, the harder the shooter is able to maintain a steady and balanced grip to the air gun, which leads to its wobbling on up-, down-, forward- and backward-directions, and affects its stability and accuracy when discharging.

The spring-piston air gun that currently available on market, includes a barrel and an air cylinder that is mounted to its main body or stock by, for example, screws, or pins, at a manner that the cylinder and the stock/main body are relatively immobilized against each other. Reducing vibration to said air guns may only be achieved by providing rubber pads to the stocks' ends in order to buffer the recoil and the vibrations generated during discharging.

Therefore, there is a need for air guns with recoil reduction devices that reduce the recoil when discharging, and provide a stable handling to the shooter.

SUMMARIZED DESCRIPTION OF THE PRESENT INVENTION

The present invention relates to a recoil reduction air gun. Said air gun's air cylinder may slidably move along its axial direction along a main body of the air gun, and its vibration reduction may be achieved by a recoil reduction device provided to a back end of the air cylinder.

One object of the present invention is to provide the air gun with reduced recoils when discharging.

According to one embodiment of the present invention, the recoil reduced air gun consists of a stock having a main body, wherein the main body is a front portion to the stock. An air cylinder and the recoil reduction device are also provided, wherein a front end of the air cylinder is slidably mounted to the main body, for example, by at least one snap cover. A piston spring seat is provided to a rare end of a inner space of the air cylinder and is fixed to the cylinder.

Said recoil reduction device consists of a recoil reduction spring seat, a first spring, a second spring, a recoil rod, and an arresting pin.

The recoil reduction spring seat has a hollow cylindrical structure with an open front end and a rear end. The rear end of the recoil reduction spring seat contacts against a first vertical surface of the stock. The front end of the recoil reduction spring seat extends into a space between the piston spring seat and the air cylinder.

Said first spring is provided in between the piston spring seat and the rear end of the recoil reduction spring seat. Said recoil rod passes through the rear end of the recoil reduction spring seat, wherein a ring is provided to the recoil rod's front end. Said second spring connects to the rear end of the recoil reduction spring seat at its first end, and the ring at its second end, respectively. By the force from the second spring, the front end of the recoil rod is pressed towards the piston spring seat, and a rear end of the recoil rod is set above a first lateral surface of the stock. A third lengthy passing is provided to the recoil rod wherein the arresting pin is inserted therein and slidably mounts the recoil rod to the stock.

In a preferred embodiment of the present invention, at least one first waist-shaped slot hole is provided to the main body, wherein the snap cover is provided to an outer side of said slot hole opposite to a side that faces the cylinder.

In yet another preferred embodiment, at least one second lengthy passing is provided to the front end of the recoil reduction spring seat. At least one screw is provided to the air cylinder. Said screw passes through the second lengthy passing and mounts the recoil reduction spring seat to the air cylinder.

Even more preferably, two second lengthy passings are provided to the front end of the recoil reduction spring seat wherein said two passings are provided at opposite directions.

In yet another preferred embodiment, a cover is provided to the rare end of the air cylinder and the stock.

According to one embodiment, the present invention provides a recoil reduction method, which provides a slidable connection between the cylinder and the main body; and, the recoil rod and the springs are provided to the space between the rare end of the cylinder and the stock. The aforementioned arrangements allow the cylinder to slide back-and-forth along the main body parallel to the longitudinal axis of the cylinder, and the recoil to be reduced by the springs. Accordingly, the present invention reduced vibrations of the air guns during discharging, and result in a more stable, and more comfortable shooting experience.

DETAILED DESCRIPTION OF THE EMBODIMENTS

Figure 1A:
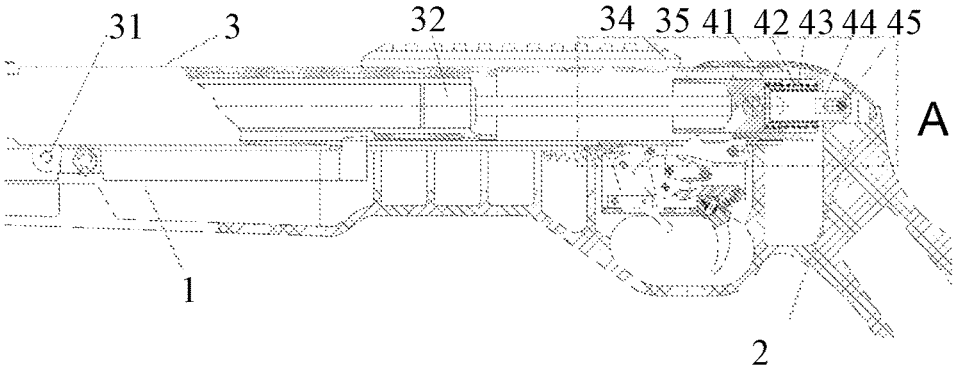
FIG. 1A is a perspective view of one embodiment of the present invention.
Figure 1B:
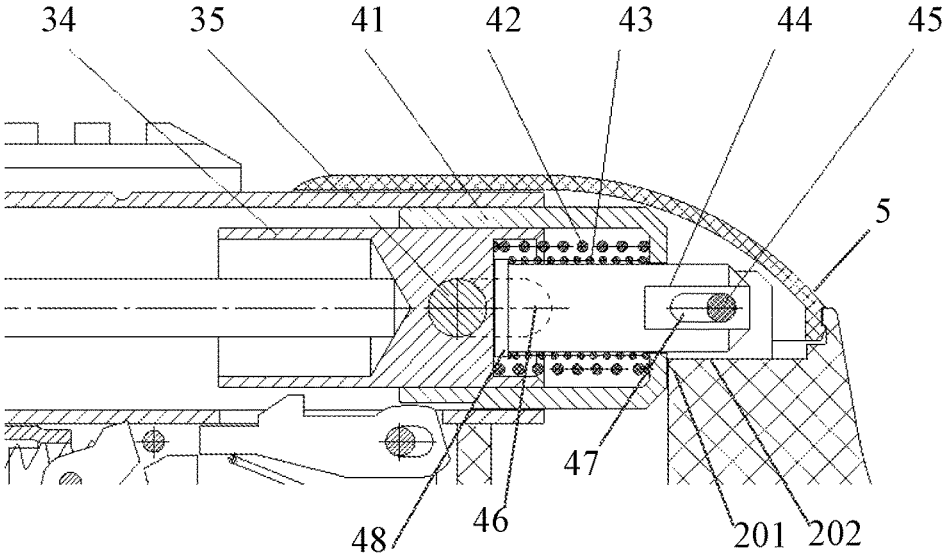
FIG. 1B is an enlarged view of dashed area A.
Figure 2:
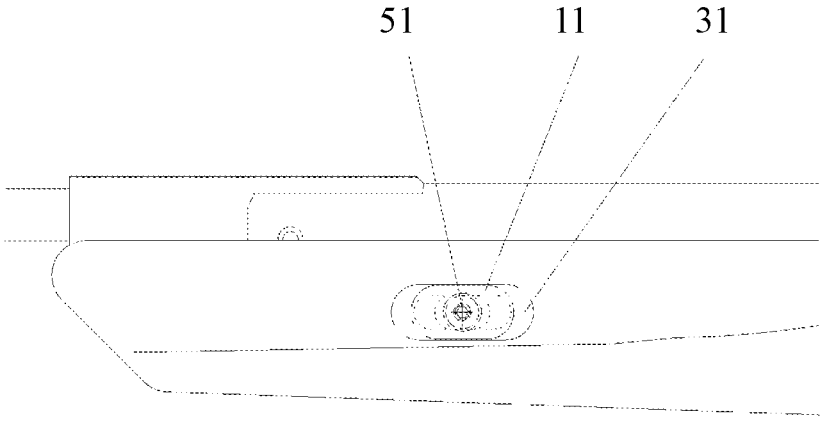
FIG. 2 is a perspective view of a front portion of one embodiment of the present invention.

As shown in FIGS. 1 and 2, a recoil reduced air gun includes a stock (2) with a main body (1). Said air gun is further provided with a cylinder (3) and a recoil reduction device (4). A front end of the cylinder is slidably mounted to the main body (1) by at least one snap cover (31), wherein said snap cover is fixed to the cylinder by a screw or a rod (51). Said main body (1) has a front end wherein at least one first waist-shaped slot hole (11) is provided thereto and said snap cover (31) is installed at an outer side of said first waist-shaped slot hole (11), wherein an inner side of said first waist-shaped slot hole faces the cylinder (3).

The first waist-shaped slot hole (11) has a first end and a second end. The two ends are set apart at a first distance (D1) that is parallel to a longitudinal axis of the cylinder (3). The first slot hole (11) also has a first side and a second side, the two sides are set apart at a first width (W) that is approximately perpendicular to the longitudinal axis of the cylinder (3). The first slot hole (11) is also provided with a first thickness (T1) of its ends and sides. The snap cover (31) has a diameter that is equal or greater than the first width (W) of the first waist-shaped slot hole (11); and is screwed to the cylinder (3) wherein a second thickness (T2) is defined as the distance between the cylinder (3) and the snap cover, which is equal to or greater than the first thickness (T1).

Accordingly, the first wast-shaped slot hole (11) allows the snap cover (31) to travel along said slot hole in between the first end and the second end at a back-and-forth direction that is parallel to the longitudinal axis of the cylinder. Since the snap cover (31) is mounted to the cylinder (3), said cylinder therefore is able to slide along the main body (1) at the back-and-forth direction that is parallel to its longitudinal axis.

It is to be noticed that above description/configuration serves as one example to the embodiments of the present invention. Other configurations may be applied by those have ordinary skills in the art, as long as the cylinder (3) is allowed to slide at the back-and-forth direction parallel to its longitudinal axis and along the main body (1), between a desired distance, or the first distance (D1).

A piston spring seat (34) is provided to a rare end of a inner space of the cylinder (3). Said piston spring seat (34) functions to hold a piston and its spring (32) in the cylinder.

Said recoil reduction device consists of a recoil reduction spring seat (41), a first spring (42), a second spring (43), a recoil rod (44), and an arresting pin (45). The stock is provided with a receiving part approximately corresponding to a rare end of the recoil reduction device. According to one embodiment of the present invention, the recoil reduction spring seat is a hollow cylinder structure having an open front end. The front end of the recoil reduction device has its diameter slightly smaller than the cylinder's diameter but bigger than the piston spring seat's diameter, thus it can extend into a space between the piston spring seat (34) and the air cylinder (3). Said first spring (42) is provided in between the piston spring seat (34) and a rear end of the recoil reduction spring seat (41), wherein the first spring contacts the piston spring seat (34) at its first end and the rear end of the recoil reduction spring seat (41) at its second end, respectively. Said recoil rod (44) passes through the recoil reduction spring seat (41) and its rear end, wherein a ring (48) is provided to the recoil rod's front end. Said second spring (43) connects to the rear end of the recoil reduction spring seat (41) at its first end, and the ring (48) at its second end, respectively.

The recoil reduction spring seat according to one particular embodiment has a cylindrical structure having a cylindrical wall which inserts and extends into the space between the piston spring seat (34) and the air cylinder (3); and a bottom wall at its rear end. The bottom wall has: (a) an inner surface that is perpendicular to the longitudinal axis of the cylinder, therefore provides supports and contacts to both first and second springs; and, (b) a bottom hole allowing the recoil rod (44) passing through.

The two springs may provide tensions necessary for keep the springs, cylinder and the seats at their original positions. For example, the first spring (42) may be slightly compressed thus the tensions have been generated. The tension from the first spring (42) pushes the recoil reduction spring seat (41) away from the cylinder (3), or, until the recoil reduction spring contacts against a first vertical surface of the stock (201) and is forced to be rest thereon. The tension from the second spring pushes against the ring (48) thus the recoil rod (44) is pushed away from the stock (2) and to the piston spring seat (34), until the front end of the recoil rod (44) contacts the piston spring seat (34) and is rest thereon; while the rare end of the recoil rod (44) is set above a first lateral surface (202) of the stock (2).

At least one second lengthy passing (46) is provided to the front end the recoil reduction spring seat (41). At least one second screw (35) is provided to the air cylinder (3), which mounts and fixes the piston spring seat (34) to the cylinder (3) while passing through the second lengthy passing (46). Said second lengthy passing (46) has a first end and a second end, wherein the second screw (35) is able to travel between said two ends by a second distance (D2) which is parallel to the longitudinal axis of the cylinder (3).

A third lengthy passing (47) is provided to the rare end of the recoil rod (44) wherein the arresting pin (45) is inserted therethrough and slidably mounts the recoil rod to the stock. Said third lengthy passing (47) has a first end and a second end, wherein the arresting pin (45) is able to travel in between the two ends by a third distance (D3) which is parallel to the longitudinal axis of the cylinder (3).

Preferably, a forth distance (D4) between the rare end of the recoil rod (44) and a second vertical surface (203) of the stock (2) is the same or less than the third distance (D3). The second distance (D2) is equal or greater than the forth distance (D4), which allows the recoil rod (44) to make contact with the second vertical surface (203). The lengthy passings and the distances allow the recoil rode (44) and/or the recoil reduction spring seat (41) to slide at the back-and-forth direction parallel to the longitudinal axis of the cylinder (3), at a maximum distance that is equal or less than the second, the third, and/or the forth distances (D2/D3/D4).

The recoil rod (44) may be mounted to the reduction spring seat (41) and/or other parts of the air gun using mechanisms that understood by those having ordinary skills in the art, so that the recoil rod is able to travel at the back-and-forth direction parallel to the longitudinal axis of the cylinder (3), and within the maximum distance.

In yet another preferred embodiment, a cover (5) is provided to a upper part of the cylinder (3) and a upper part of the stock (2).

Figure 3:
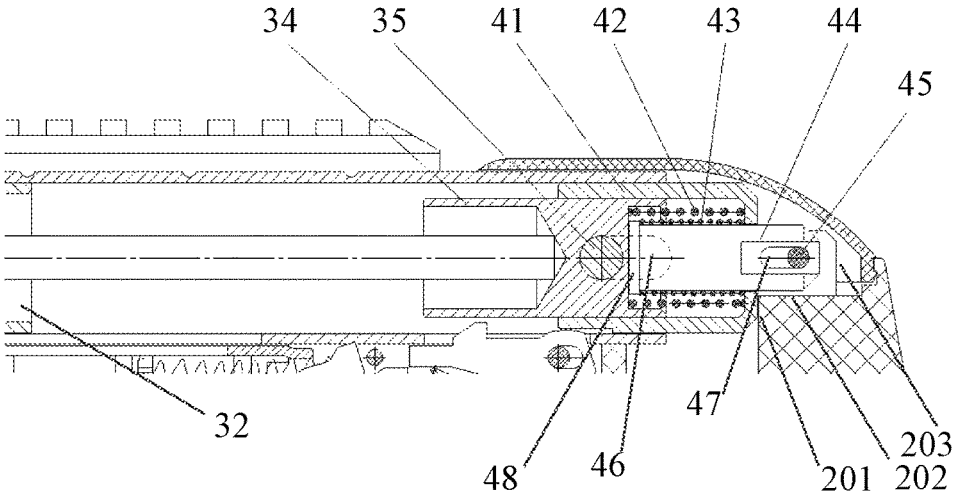
FIG. 3 is a perspective view of one embodiment of the present invention at an original status.

The mechanism of recoil reductions are described herein. FIG. 3 shows that, in a pre-discharging status, or a first status, or an "original status," balances have been achieved between frictions among parts and tensions from the springs. The springs thus are rested at their original lengths, respectively.

Figure 4:
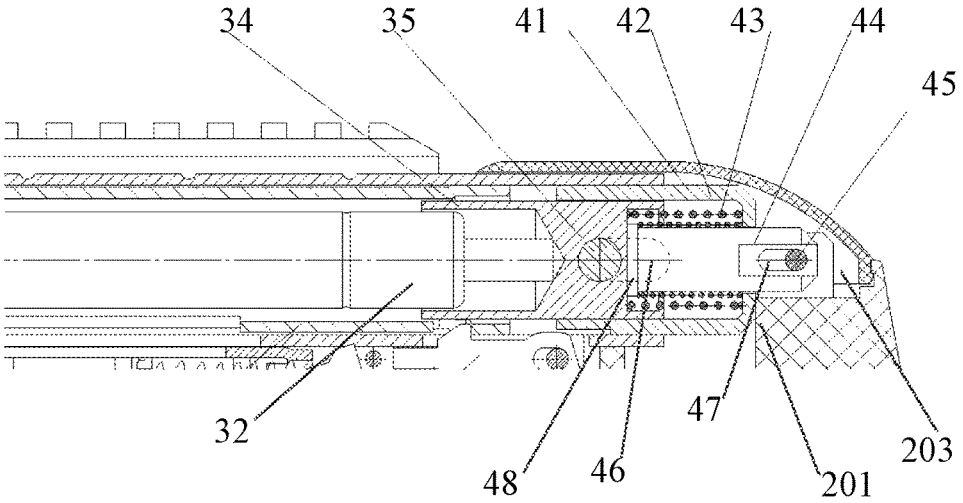
FIG. 4 is a perspective view of one embodiment of the present invention before discharging.

FIG. 4 shows that the piston spring is compressed and the piston is arrested close to the piston spring seat (34). The tensions from the first and the second springs (42&43) press:

(1), the recoil rod (44) away from the second vertical surface (203) and in contact with the piston spring seat (34), until the arresting pin (45) is pressed against its second end and arrests the recoil rod (44) from moving further away from the second vertical surface (203); and, (2), the piston spring seat (34) and cylinder (3) away from the vertical surfaces of the stock (2), until the snap cover (31) reaches and is restrained by the first end of the slot hole (11), and/or the second screw (35) is restrained by the first end of the second lengthy passing (46) in a similar manner thereto, so that positions of the piston spring seat (34) and the cylinder (3) may be secured.

The above description of positions of the springs, the seats, and the recoil rod may be collectively referred as their "original positions".

Figure 5A:
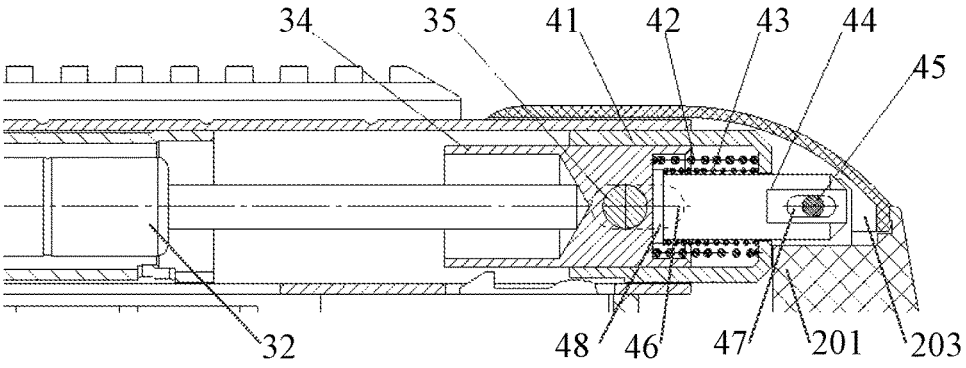
FIGS. 5 A, B & C are perspective views of one embodiment of the present invention after discharging.
Figure 5B:
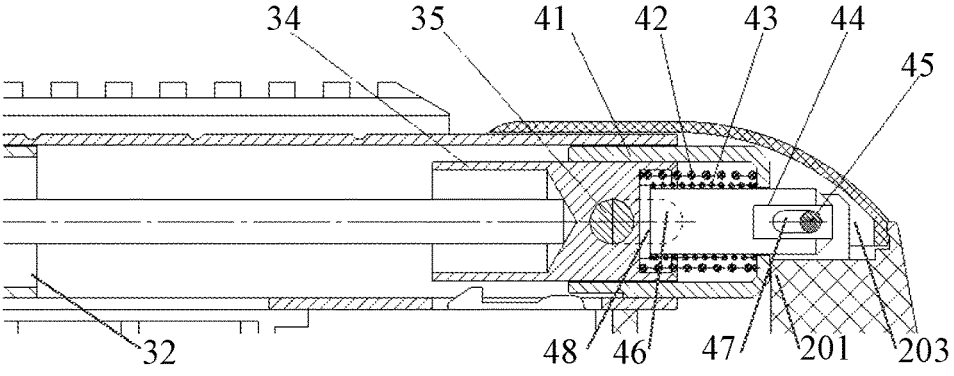
Figure 5C:
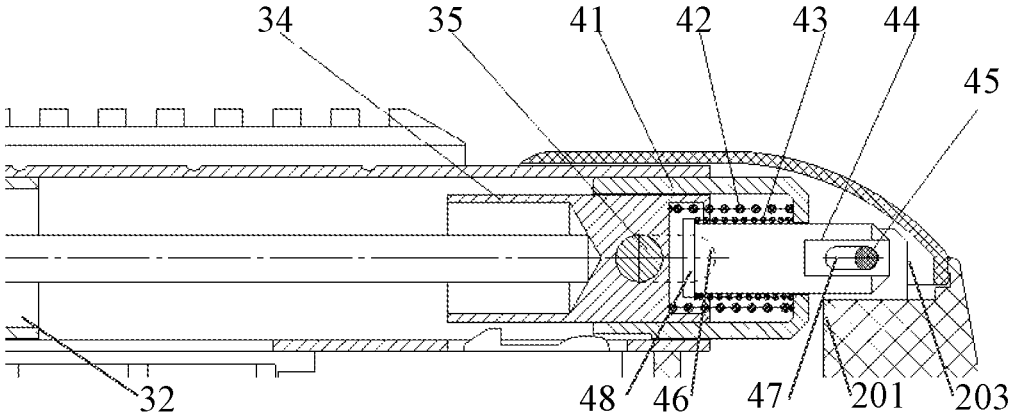

FIG. 5 shows movements of the parts after discharging. When discharging the air gun, the piston is released and driven along the cylinder (3) towards a muzzle. At the same time, the piston spring seat (34) is pushed backwards from its original position to the stock (2) by the recoil. Because the piston spring seat (34) is mounted and fixed to the cylinder (3), the cylinder (3) is also moving backwards from its original position.

The moving piston spring seat (34) first presses the first spring (42) to the vertical surfaces of the stock (2). Because the recoil reduction spring seat (41) is in contact and set against the first vertical surface (201) of the stock, said seat (41) is relatively steady against the stock (2). Therefore the first spring (42) is compressed by the combination of the moving piston spring seat (34) and the steady recoil reduction spring seat (41). The tension is generated during the compression process against the piston spring seat (34), which is moving to the stock (2).

The moving piston spring seat (34) also pushes the recoil rod (44) from its original position to the second vertical surface of the stock (203). During the process the second spring (43) is also compressed by the moving recoil rod (44) and the steady recoil reduction spring seat (41). The tension is also generated during the compression process of the second spring (43), and against the moving piston spring seat (34).

As the piston spring seat (34) moving further to the stock (2), said two springs are further compressed thus the tensions generated are increasing along with the compression processes. Eventually, the springs are compressed to their minimum lengths and the piston spring seat (34) is forced to stop moving further to the stock (2).

As shown in FIG. 5B, the tensions then push the recoil rod (44) and the piston spring seat (34), as well as the cylinder (3), moving forwards and away from the stock (2) and to the muzzle along the longitudinal axis of the cylinder (3). As the piston spring seat now traveling to the muzzle, the springs are gradually de-compressing and as the tensions are reducing accordingly.

The cylinder (3) and the piston spring seat (34) may move forward and pass their original positions in the first status.

At the same time, the tensions also push the recoil reduction spring seat backwards and to the stock (2). Because said seat (34) is in contact with the stock (2) and could not be further pushed, it remains steady relatively against the stock (2).

The recoil rod (44) is pushed to move forwards and to the muzzle also by the tensions, mostly generated by the second spring (43). The arresting pin (45) is fixed to the stock (2) thus remains relatively steady against the stock (2), but, relatively sliding from the first end to the second end of the third lengthy passing (47) until contacting thereto. Then, the recoil rod (44) is arrested by the arresting pin (45) and is prevented from further moving forwards.

As shown in FIG. 5 C, as the piston spring seat (34) keeps moving forward, the second screw (35) may be pressed against the first end of the second lengthy passing (46) of the recoil reduction spring seat (41). A forwarding force is transmitted from the second screw (35) to the recoil reduction spring seat (41), which is then driven forward, left and away from the first vertical surface of the stock (201).

Then, the forward moving recoil reduction spring seat (41) and the relatively steady recoil rod (44), now start to compress the second spring (43) again. Because the recoil rod (44) is arrested and prevent from any forward movement; the tension generated during this second compression process works against the recoil reduction spring seat (41) to the stock (2). Meanwhile, the first spring (42) keeps de-compressing.

As the piston spring seat (34) further moving forward, the first spring (42) is further de-compressed and the second spring (43) is further compressed, leading a decreasing tension from the first spring (42) and a increasing tension from the second spring (43). Eventually, the tension from the second spring overpowers the tension from the first spring, thus the recoil reduction spring seat (41) gradually slows down its speed in moving forward until a total stop, then start to move backwards to its original position and/or the stock again.

Part of the tensions may be transmitted from the recoil reduction spring seat (41) to the piston spring seat (34) and the cylinder (3) through the second screw (35). Therefore, the piston spring seat (34) and the cylinder (3) will gradually slow down their speeds in moving forward, make a total stop, then start to move backwards to their original positions and/or the stock again.

As soon as the piston spring seat (34) and the cylinder (3) pass their positions in the original positions, the recoil reduction device repeats its function as described hereabove.

Theoretically, the process described in this embodiment could be repeated multiple times after discharging, until the recoil are finally exhausted by compressing and de-compressing of the springs, then the cylinder (3) and the piston spring seat (34) are able to stop their movements.

In reality, said recoil is rapidly consumed by frictions and/or absorbed by the user. So that after a few repeats, the cylinder (3) and the piston spring seat (34) are able to stop their movements and ready for next discharge.

The recoil reduction device is able to buffer the recoil by delaying the backward movement of the cylinder (3) and the piston spring seat (34). The time required to transmit the recoil from the piston spring seat (34) to the user is extended by this delay, leading to less impact to the user. At the same time, part the recoil is consumed by the frictions and by compressing and de-compressing the springs, thus will not be transmitted to the user. Altogether, comparing to prior art air guns which transmit all recoils immediately and directly to the user, said device of the present invention significantly reduces the impact and shocks caused by the recoil to the user, and creates a more comfortable shooting experience to the user.

The choices of the springs, and the determinations of the distances, could be calculated by those having ordinary skills in the art.

Although certain embodiments constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

The terms "first," "second," and the like, if and where used herein, do not denote any order, quantity, or importance, but rather are used to distinguish one element from another, and the terms "a" and "an" herein do not denote a limitation of quantity, but rather denote the presence of at least one of the referenced item. The modifier "approximately", where used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals).

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

We claim:

1. A recoil reduction air gun, comprising: a stock with a main body; a cylinder that is slidably mounted to and is able to move along the main body at a back-and-forth direction that is parallel to a longitudinal axis of the main body; a piston spring seat is provided to an inner space of the cylinder; and a recoil reduction device is provide between the piston spring seat and the stock;

said recoil reduction device consisting of: a recoil reduction spring seat (41), a first spring (42), a second spring (43), a recoil rod (44), and an arresting pin (45);

a front end of the recoil reduction device extends into a space between the piston spring seat (34) and the cylinder (3); said first spring (42) is provided in between the piston spring seat (34) and the recoil reduction spring seat (41), wherein a first end of the first spring contacts the piston spring seat (34) and a second end of the first spring contacts the recoil reduction spring seat (41);

said recoil rod (44) passes through the recoil reduction spring seat (41), wherein a ring (48) is provided to the recoil rod's front end; and, a first end of said second spring (43) connects to the recoil reduction spring seat (41), and a second end of said second spring connects to the ring (48).

2. The recoil reduction air gun from claim 1, further comprising: at least one snap cover that is fixed to a front end of the cylinder and at least one first waist-shaped slot hole provided to the main body, wherein the snap cover is provided to an outside of said slot hole opposite to the cylinder; the snap cover (31) has a diameter that is greater than a width of the first waist-shaped slot hole (11), and is screwed to the cylinder (3) wherein a second thickness (T2) is generated between the cylinder (3) and the snap cover, which is greater than a first thickness (T1) of said slot hole; and, the snap cover is allowed to travel from a first end to a second end of said slot hole along a first distance between the two ends and is parallel to a longitudinal axis of the cylinder.

3. The recoil reduction device of claim 1, further comprising: at least one second lengthy passing (46) is provided to a front end the recoil reduction spring seat (41), and at least one second screw (35) is provided to the cylinder (3), which is screwed and fixed the piston spring seat (34) to the cylinder (3) while passing through the second lengthy passing (46).

4. The recoil reduction device of claim 1, further comprising: the arresting pin is fixed to the stock; and, a third lengthy passing (47) is provided to the recoil rod (44) wherein the arresting pin (45) is inserted therethrough, wherein the recoil rod (44) is able to travel along a third distance (D3) between a first end and a second end of the third lengthy passing that is parallel to the longitudinal axis of the cylinder.

5. The recoil reduction device of claim 4, further comprising: a fourth distance (D4) between the rare end of the recoil rod (44) and a second vertical surface (203) of the stock (2) is the same as the third distance.

6. A recoil reduction device for air guns with a piston spring seat and a cylinder, comprising: a recoil reduction spring seat (41), a first spring (42), a second spring (43), a recoil rod (44), and an arresting pin (45); a front end of the recoil reduction device extends into a space between the piston spring seat (34) and the cylinder (3); said first spring (42) is provided in between the piston spring seat (34) and the recoil reduction spring seat (41), wherein a first end of the first spring contacts the piston spring seat (34) and a second end of the first spring contacts the recoil reduction spring seat (41); said recoil rod (44) passes through the recoil reduction spring seat (41), wherein a ring (48) is provided to the recoil rod's front end; and, a first end of said second spring (43) connects to the recoil reduction spring seat (41) and a second end of said second spring connects to the ring (48).

7. The recoil reduction device of claim 6, further comprising: at least one second lengthy passing (46) is provided to a front end the recoil reduction spring seat (41), and at least one second screw (35) is provided to the cylinder (3), which is screwed and fixed the piston spring seat (34) to the cylinder (3) while passing through the second lengthy passing (46).

8. The recoil reduction device of claim 6, further comprising: the arresting pin is fixed to the stock; and, a third lengthy passing (47) is provided to the recoil rod (44) wherein the arresting pin (45) is inserted therethrough, wherein the recoil rod (44) is able to travel along a third distance (D3) between a first end and a second end of the third lengthy passing that is parallel to the longitudinal axis of the cylinder.

9. The recoil reduction device of claim 8, further comprising: a fourth distance (D4) between the rare end of the recoil rod (44) and a second vertical surface (203) of the stock (2) is the same as the third distance.

* * * * *